United States Patent [19]

Ells

[11] Patent Number: 4,811,652

[45] Date of Patent: Mar. 14, 1989

[54] PRESSURE DEVICE

[75] Inventor: John W. Ells, Bexleyheath, England

[73] Assignee: The British Petroleum Company p.l.c., London, England

[21] Appl. No.: 439,934

[22] Filed: Nov. 8, 1982

[30] Foreign Application Priority Data

Nov. 13, 1981 [GB] United Kingdom ..... 8134217

[51] Int. Cl.[4] ..... F01B 19/00

[52] U.S. Cl. ..... 92/92; 92/48

[58] Field of Search ..... 92/48, 92; 251/172

[56] References Cited

U.S. PATENT DOCUMENTS

| | | | |
|---|---|---|---|
| 2,467,883 | 4/1949 | Edwards | 92/48 |
| 3,650,181 | 3/1972 | Parr | 92/48 |
| 3,800,674 | 4/1974 | Sember | 92/48 |
| 3,975,989 | 8/1976 | Hirmann | 92/48 |

FOREIGN PATENT DOCUMENTS

| | | | |
|---|---|---|---|
| 1210282 | 2/1966 | Fed. Rep. of Germany | 251/172 |
| 2229821 | 6/1972 | Fed. Rep. of Germany | 92/48 |
| 2609316 | 10/1976 | Fed. Rep. of Germany | 251/172 |

*Primary Examiner*—Alan Cohan

*Assistant Examiner*—John C. Fox

*Attorney, Agent, or Firm*—Morgan & Finnegan

[57] ABSTRACT

An overpressure device for applying pressure from a first hydraulic fluid to a second hydraulic fluid comprises:

(a) a housing in which is located a piston (b) an opening in the housing for the entry of the first hydraulic fluid to one side of the piston (c) a second opening in the housing for the entry of the second hydraulic fluid to a chamber on the other side of the piston whereby the pressure of the first hydraulic fluid is exerted on the second hydraulic fluid, and (d) an additional means of exerting pressure on the piston so that pressure exerted on the second hydraulic fluid is greater than that of the first hydraulic fluid alone.

The overpressure device is particularly suitable for use in applying pressure to the sealing system of the ball valve described in European patent application No. 82302173 when used to control the flow of fluid, e.g. crude oil in a pipeline. The overpressure device enables the pressure in the pipeline to provide a portion of the pressure required to pressurize the sealing system.

8 Claims, 2 Drawing Sheets

PRESSURE DEVICE

Figure 1:
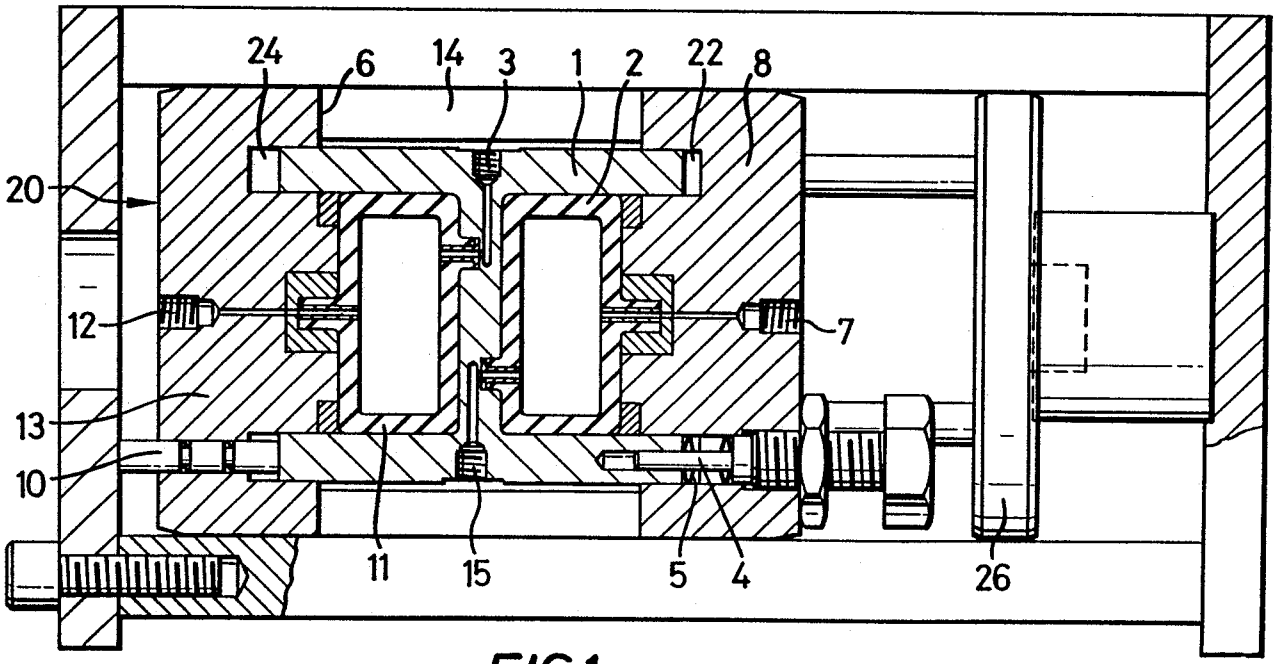

This invention relates to a device for applying a hydraulic pressure, more particularly to an overpressure device suitable for use in pipeline operations. The invention also relates to a pipeline valve system comprising a ball valve and the overpressure device.

Ball valves are known and have been previously used in oil and gas pipelines. The valves comprise a body within which is a steel sealing ring which compresses a sealing element of compressible material into engagement with the ball to effect the sealing. The compressible material of which the elements are made and the surface of the ball itself tend to be eroded, possibly in the case of a crude oil pipeline, by produced solids such as sand, and as a result to develop leaks. When a leak has developed it is currently necessary to replace the entire ball valve. This operation is expensive since, in addition to the cost of the replacement ball valve, the pipeline has to be closed down and oil production probably interrupted.

In our copending European Patent Application No. 82302173.8 there is described and claimed a sealing assembly which provides an additional means of sealing against the ball or other non-compressible surface, the additional means being located on either the low pressure or high pressure side of the compressible sealing element so that, nowithstanding the presence of small surface irregularities on the ball, leaks are prevented and the useful life of the seal prolonged.

Use of the sealing assembly described in the above mentioned patent application requires a pressure to be applied to the sealing system which is greater than the pressure in the pipeline on either side of the valve. This difference in pressure is referred to as the overpressure.

It is however convenient to employ the pressure in the pipeline itself to provide a portion of the pressure to pressurise the sealing system. It is, therefore, an object of the present invention to provide an overpressure device suitable for providing a hydraulic pressure to the sealing system described in European Patent Application No. 82302173.8 and which utilises the pressure in the pipeline itself.

Thus, according to the present invention an overpressure device for applying pressure from a first hydraulic fluid to a second hydraulic fluid comprises:

(a) a housing in which is located a piston,
(b) an opening in the housing for the entry of the first hydraulic fluid to one side of the piston,
(c) a second opening in the housing for the entry of the second hydraulic fluid to a chamber on the other side of the piston whereby the pressure of the first hydraulic fluid is exerted on the second hydraulic fluid, and
(d) an additional means of exerting pressure on the piston so that pressure exerted on the second hydraulic fluid is greater than that of the first hydraulic fluid alone.

The additional means for exerting pressure on the piston suitably comprises one or more compression springs. Adjusting means may be provided to preset the additional pressure.

In use, the piston is preferably fixed in position and the housing is movable.

The chambers on each side of the piston are suitably provided by expandable bags which are inflatable by the hydraulic fluid.

The chambers are preferably fitted with bleed facilities.

According to another aspect of the invention a pipeline system comprises a valve, for example a ball valve, the sealing assembly of which cooperates with an overpressure device as hereinbefore described, the valve being located in a pipeline and wherein the overpressure device is connected to the pipeline so that the pressure in the pipeline provides the hydraulic part of the pressure applied to the operation of the sealing assembly of the valve.

Figure 2:
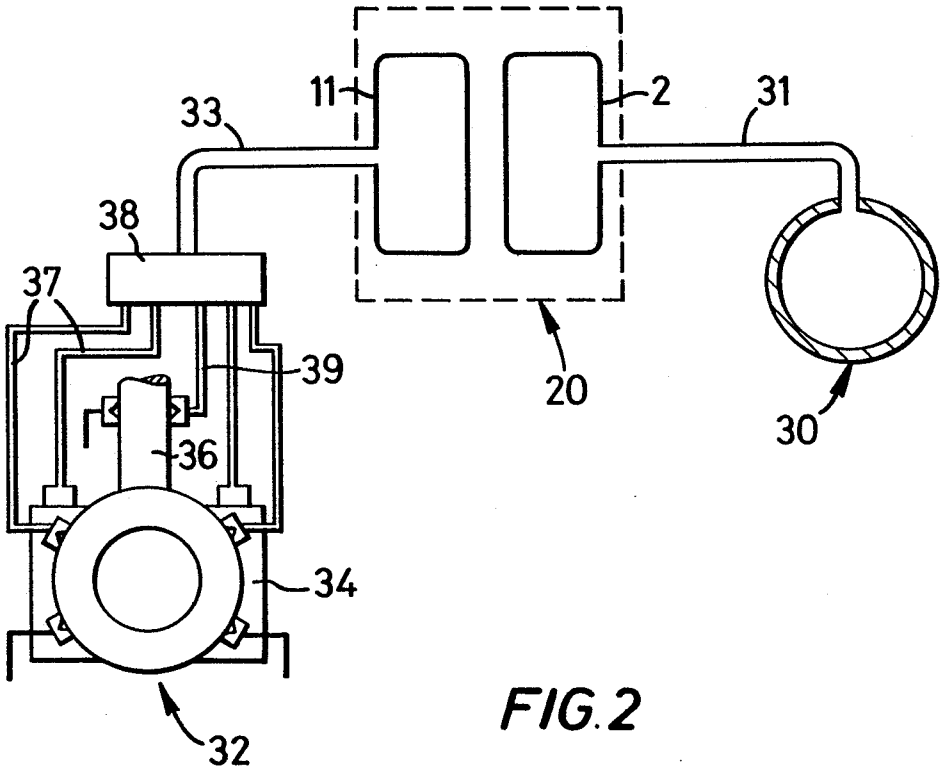

The invention is illustrated by the accompanying drawings in which FIG. 1 is a full scale vertical section through the device and FIG. 2 is a schematic drawing showing the assembly of overpressure device and pipeline ball valve.

Referring to FIG. 1 the device comprises a housing 20 provided by end plates 8 and 13. The plates 8, 13 and spacers 14 are held together by means of screw threads. Located within the housing is a fixed double hollow piston 1. Grooves 22 and 24, are provided in each of the end plates 8 and 13 to provide annular guides to facilitate the axial movement of the end plate assembly 6. Located inside each side of hollow piston 1 is an inflatable rubber bag indicated by numerals 2 and 11, each of which is connected by means of connectors 7 and 12 respectively to hydraulic lines (not shown) whereby the interior of each bag is in hydraulic communication with its respective hydraulic line. Connectors 3 and 15 provide hydraulic bleed facilities. Three rods 10 located symmetrically with respect to the axis of the device are connected to the hollow piston 1. Only one of the three rods 10 is shown because of the section taken. Acting in opposition to the rods 10 are three columns of disc springs under compression only one of which 5 with its support column 4 is shown. The loading on the compression springs 5 can be adjusted by means of screw threads on columns 4. The three columns of springs 5 have been previously compressed to provide a force sufficient to provide the required overpressure to be transmitted to the inflatable bag 11. In use line pressure is applied via connection 7 to inflatable rubber bag 2 which urges movement of the end plate 8 from left to right when activated.

When the actuating plate 26 and the end plate assembly 6 is moved from left to right by the valve actuator, bag 2 expands applying a force to bag 11, via plate assembly 6, and pressurizing the fluid in bag 11 to the same pressure contained in bag 2. Simultaneously the three columns of springs 5 provide an additional force to further compress bag 11 and increasing the pressure inside to a predetermined constant value. Whatever the pipeline pressure may be at any time, this device, when activated, will always apply a sensibly constant force to compress bag 11 which will provide the seals with a constant hydraulic overpressure. The amount of overpressure required can be determined by adjusting the screw threaded spring support column 4. To deactivate the device an external force is required, from the valve actuator. The effect of this is to move the end plate assembly 6 from right to left reducing the pressure in bag 11 down to the pipeline pressure or less. The device is then ready for a further cycle of use.

Referring to FIG. 2 the pipeline valve system comprises a ball valve 32 having a sealing assembly as described in our copending European Patent Application No. 82302173.8 connected by lines 37 and 39 to a hydraulic manifold 38 which communicates by line 33 with inflatable bag 11 of the overpressure device 20. The inflatable bag 2 of the overpressure device is pressurised via line 31 which is connected to a pipeline 30 which is the pipeline in which the ball valve 32 works. The seals on the valve stem 36 are pressurised by hydraulic fluid in line 34.

I claim:

1. A constant differential overpressure device for applying pressure from a first hydraulic fluid to a second hydraulic fluid comprising:

(a) a housing in which is located a double hollow piston having one side for receiving a first chamber adapted to receive a first hydraulic fluid and another side for receiving a second chamber adapted to receive a second hydraulic fluid, (b) an opening in the housing for the entry of the first hydraulic fluid to said first chamber on one side of the piston, (c) a second opening in the housing for the entry of the second hydraulic fluid to said second chamber on the other side of the piston whereby the pressure of the first hydraulic fluid is exerted on the second hydraulic fluid, and (d) additional means of exerting pressure on the piston so that the pressure exerted on the second hydraulic fluid is greater than that of the first hydraulic fluid.

2. An overpressure device according to claim 1 wherein the additional means 5 for exerting pressure on the piston 1 comprises one or more compression springs.

3. An overpressure device according to claim 1 wherein the piston is fixed and the housing is movable.

4. An overpressure device according to claim 1 wherein the chambers on each side of the piston are provided by expandable bags which are inflatable by the hyraulic fluids.

5. An overpressure device according to claim 1 wherein the chambers on either side of the piston are provided with bleed lines.

6. An overpressure device according to claim 1 wherein adjusting means is provided for adjustably presetting the additional pressure.

7. A pipeline system comprising a valve located in a pipeline wherein the valve comprises a hydraulically actuated sealing assembly which cooperates with an overpressure device according to claim 1, the over pressure device being connected to the pipeline so that the pressure in the pipeline provides the hydraulic part of the pressure applied to the operation of the sealing assembly of the valve.

8. A pipeline system according to claim 7 wherein the valve is a ball valve.

* * * * *